US005515445A

United States Patent [19]

Baumhauer, Jr. et al.

[11] Patent Number: 5,515,445

[45] Date of Patent: May 7, 1996

[54] LONG-TIME BALANCING OF OMNI MICROPHONES

[75] Inventors: John C. Baumhauer, Jr., Indianapolis; Jeffrey P. McAteer, Fishers; Alan D. Michel, Noblesville, all of Ind.; Kevin D. Willis, Owensboro, Ky.

[73] Assignee: AT&T Corp., Murray Hill, N.J.

[21] Appl. No.: 268,464

[22] Filed: Jun. 30, 1994

[51] Int. Cl.[6] ..... H04R 3/00

[52] U.S. Cl. ..... 381/92; 381/94; 381/95

[58] Field of Search ..... 381/71, 73.1, 91, 381/92, 94, 95, 93

[56] References Cited

U.S. PATENT DOCUMENTS

| | | | |
|---|---|---|---|
| 3,542,954 | 6/1968 | Flanagan | 179/1 |
| 4,653,102 | 3/1987 | Hansen | 381/94 |
| 5,226,087 | 7/1993 | Ono et al. | 381/92 |

*Primary Examiner*—Scott A. Rogers
*Assistant Examiner*—Jerome Grant, II
*Attorney, Agent, or Firm*—Thomas Stafford

[57] ABSTRACT

The long term average broad band gains of a plurality of individual signal channels, associated with a corresponding plurality of microphone elements, are electronically and dynamically adapted to one another. This is realized by periodically and dynamically processing the signals from the individual microphone elements. More specifically, the processing is such that the long term average broad band gain of the signal channels of the individual microphone elements is dynamically adjusted, an energy estimate of each microphone signal channel is averaged over the long term and the difference in energy between the signal channels is used to readjust the long term average broad band gain of the microphone signal channels to minimize those differences. In one embodiment, the adjustment is realized by obtaining an estimate of the energy of the adjusted signal in each microphone signal channel, obtaining the differences between the energy estimates and averaging the difference over the long term to obtain a gain differential correction factor which is used to readjust the long term broad band gain of at least one of the microphone signal channels to minimize the gain difference between the microphone signal channels. In another embodiment, a long term estimate of the energy in each microphone signal channel is obtained. A ratio of the energy estimates is obtained and used to adjust the long term average broad band gain of at least one of the microphone signal channels to equalize the gain in the microphone signal channels.

5 Claims, 4 Drawing Sheets

FIG. 1
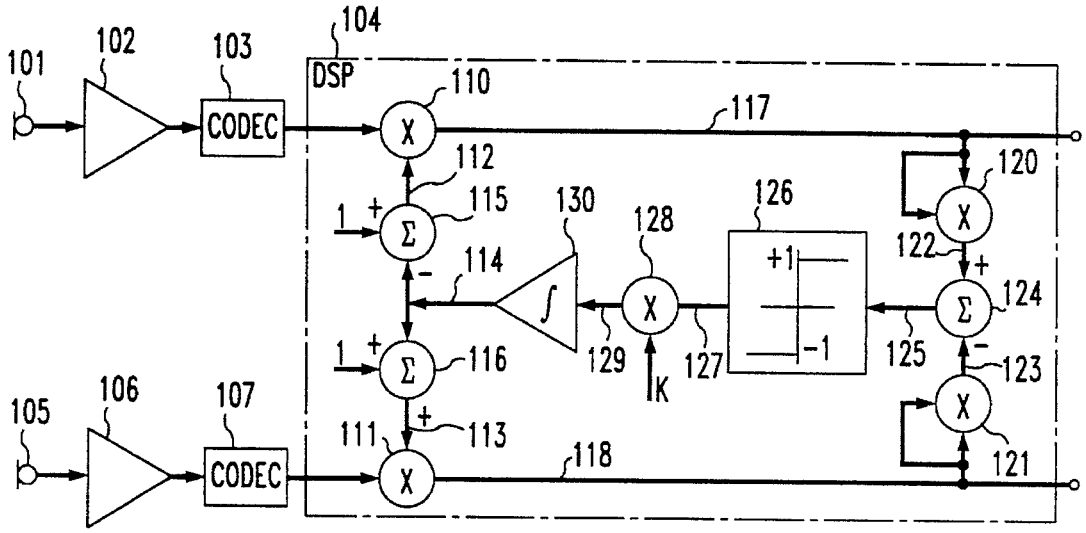
FIG. 2
MEASURED DIRECTIVITY OF MISMATCHED MICROPHONES
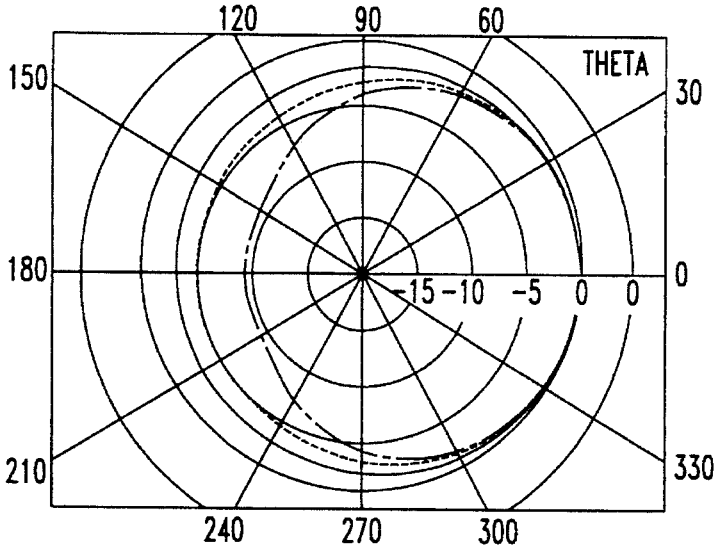
FIG. 2A
POLAR RESPONSE
500 Hz
1000 Hz
3000 Hz
FIG. 2B
DIRECTIVITY INDEX
500 Hz = 1.7dB
1000 Hz = 2.6dB
3000 Hz = 3.6dB

*FIG. 3*
MEASURED DIRECTIVITY WITH MATCHED MICROPHONES
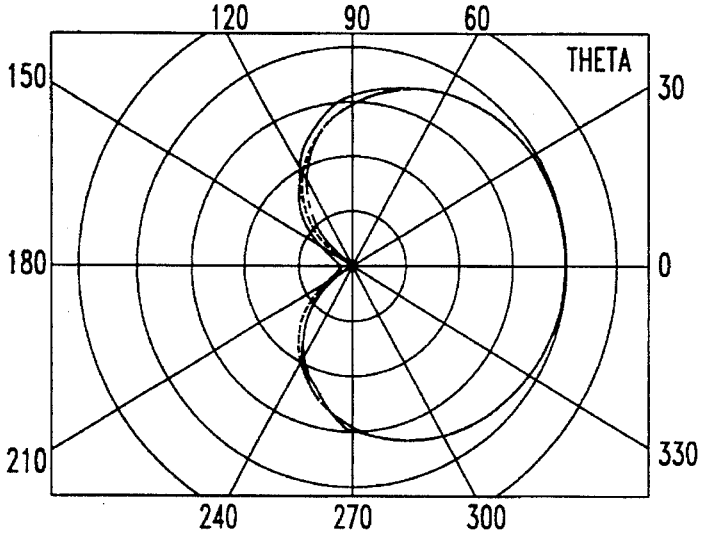
*FIG. 3A*
POLAR RESPONSE
500 Hz
1000 Hz
3000 Hz
*FIG. 3B*
DIRECTIVITY INDEX
500 Hz = 4.3dB
1000 Hz = 4.3dB
3000 Hz = 4.4dB
*FIG. 4*
SIMULATED DIRECTIVITY WITH MICROPHONE MISMATCH
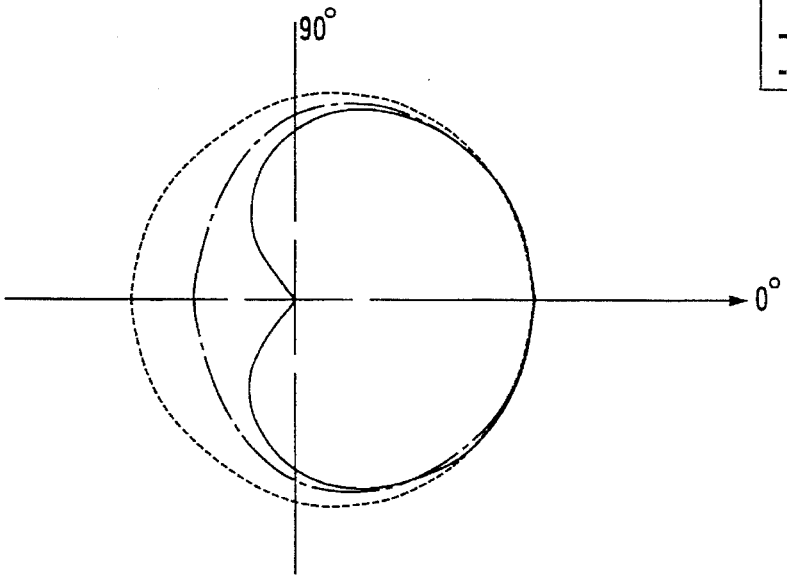
*FIG. 4A*
0dB, DI=4.8dB
1dB, DI=4.0dB
2dB, DI=2.9dB

LONG-TIME BALANCING OF OMNI MICROPHONES

CROSS REFERENCE TO RELATED APPLICATIONS

U.S. patent applications Ser. No. 08/268,463 and Ser. No. 08/768,462 were filed concurrently herewith.

1. Technical Field

This invention relates to microphone systems and, more particularly, to matching of the microphone elements utilized in the system.

2. Background of the Invention

One way to construct a directional microphone is to utilize a gradient microphone element whereby the sound is subtracted across both sides of a diaphragm, thus forming a pressure gradient microphone response and directional beam. However, such microphone elements tend to be expensive, and are limited in their application. Additionally, the polar directivity pattern for such microphones is fixed and may not be modified. Another approach is to utilize two or more microphone elements and perform an electrical subtraction, as opposed to an acoustic subtraction. In such systems, it has been necessary to use matched microphone elements to begin with, i.e., basic microphone elements that have the same sensitivity response. Such microphone elements have been difficult to obtain and are expensive because it has been necessary to match them either in a manufacturing environment or in service. In the past, a method that was used was to either sort the microphone elements into closely matched groups, or to use manual means to adjust the sensitivity of one microphone to another. However, both of these prior approaches are time and/or labor intensive. Use of such fixed sensitivity microphone elements, even if matched originally, would create problems in some applications where the distance from the sound source is variable. Additionally, in certain types of microphone elements, for example, the well known electret type, the microphone sensitivity may change with time at an unknown rate, which can cause the fixed gain system to become unbalanced over time.

SUMMARY OF THE INVENTION

The problems and limitations with prior microphone elements employed in such acoustic systems are overcome electronically by dynamically and adaptively matching the long term average broad band gain, i.e., gain, of the individual signal channels associated with the microphone elements to one another. This is realized by periodically and dynamically processing the signals from the individual microphone elements.

More specifically, the processing is such that the long term average broad band gain of the signal channels of the individual microphone elements is dynamically adjusted, an energy estimate of each microphone signal channel is averaged over the long term and the difference in energy between the signal channels is used to readjust the long term average broad band gain of the microphone signal channels to minimize those differences.

In one embodiment, the adjustment is realized by obtaining an estimate of the energy of the adjusted signal in each microphone signal channel, obtaining the differences between the energy estimates and averaging the difference over the long term to obtain a gain differential correction factor which is used to readjust the long term average broad band gain of at least one of the microphone signal channels to minimize the gain difference between the microphone signal channels.

In another embodiment, a long term estimate of the energy in each microphone signal channel is obtained. A ratio of the energy estimates is obtained and used to adjust the long term average broad band gain of at least one of the microphone signal channels to equalize the gain in the microphone signal channels.

BRIEF DESCRIPTION OF THE DRAWINGS:

FIG. 1 is a signal flow diagram showing a two microphone system employing one embodiment of the invention:

FIG. 2 shows polar directivity patterns for a cardioid microphone formed with unmatched elements;

FIG. 3 shows polar directivity patterns for the same microphones of FIG. 2 after signal channels have been matched employing the invention;

FIG. 4 shows a family of first order gradient cardioid patterns at a single frequency with varying degrees of sensitivity mismatch between the two microphone elements used in forming them;

DETAILED DESCRIPTION

Figure 5:
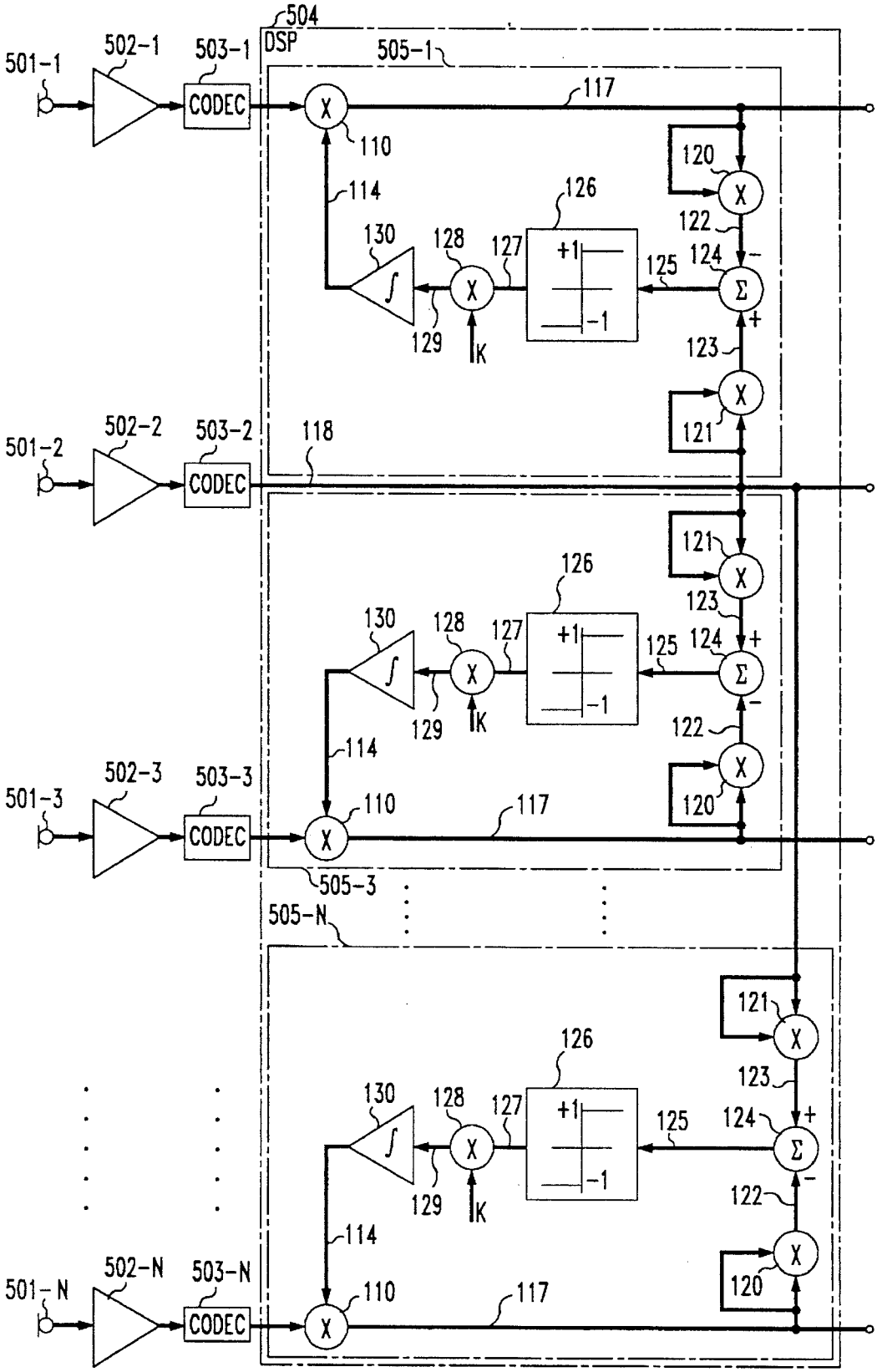
FIG. 5 shows a signal flow diagram employed in matching the signal channels associated with N microphone elements.

FIG. 1 illustrates in simplified form a signal flow diagram for matching the signal channels associated with two microphone elements employing one embodiment of the invention. It is noted that the signal flow diagram of FIG. 1 illustrates the signal flow processing algorithm which may be employed in a digital signal processor (DSP) to realize the invention. It is noted, however, although the preferred embodiment of the invention is to implement it on such a digital signal processor, that the invention may also be implemented as an integrated circuit or the like. Such digital signal processors are commercially available, for example, the DSP 1600 family of processors available from AT&T.

Shown in FIG. 1 is microphone element 101 having its output supplied via amplifier 102 and Codec 103 to DSP 104 including the digital signal flow processing to realize the invention. Also shown is microphone element 105 whose output is supplied via amplifier 106 and Codec 107 to DSP 104. In one example employing the invention, microphone elements 101 and 105 are so-called omni-directional microphones of the well-know electret type. Although other types of microphone elements may utilize the invention to be matched, it is the electret type that are the preferred ones because of their low cost. Codecs 103 and 107 are also well known in the art. One example of a Codec that can advantageously be employed in the invention is the T7513B Codec, also commercially available from AT&T. In this example, the digital signal outputs from Codecs 103 and 107 are encoded in the well-known mu-law PCM format, which in DSP 104 must be converted into a linear PCM format. This mu-law to linear PCM conversion is well known. The linear PCM versions of the signals from Codecs 103 and 107 are then applied to multipliers 110 and 111, respectively. Multiplier 110 employs a first gain correction factor 112 to adjust the gain of the linear PCM version of the signal from Codec 103 to obtain an adjusted output signal 117 for microphone element 101. Similarly, multiplier 111 employs a second gain correction factor 113 to adjust the linear PCM version of the signal from Codec 107 to obtain the adjusted output signal 118 for microphone element 105. The present gain correction factors 112 and 113 are obtained by adding and subtracting a gain differential correction factor 114 to a predetermined constant value. To this end, the gain differential correction factor 114 is subtracted via algebraic summing unit 115 from a predetermined value, in this example, the value one (1), to obtain present gain correction factor 112, and the gain differential correction factor 114 is added via algebraic summing unit 116 to the predetermined value one (1), to obtain present gain correction factor 113.

The gain differential correction factor 114 is obtained in the following manner: adjusted microphone output signal 117 is squared via multiplier 120 to generate an energy estimate value 122. Likewise, adjusted microphone output signal 118 is squared via multiplier 121 to generate energy estimate value 123. Energy estimate values 122 and 123 are algebraically subtracted from one another via algebraic summing unit 124, thereby obtaining a difference value 125. The sign of the difference value is obtained using the signum function 126, in well known fashion, to obtain signal 127. Signal 127 will be either minus one (−1) or plus one (+1) indicating which microphone signal channel had the highest instantaneous energy. Minus one (−1) represents microphone element 105, and plus one (+1) represents microphone element 101. Multiplier 128 multiplies signal 127 by a constant K to yield signal 129 which is a scaled version of signal 127. In one example, not to be construed as limiting the scope of the invention, K typically would have a value of $10^{-5}$ for a 22.5 ks/s (kilosample per second) sampling rate. Integrator 130 integrates signal 129 to provide the current gain differential correction factor 114. The integration is simply the sum of all past values. In another example, constant K would have a value of $5\times10^{-6}$ for an 8 ks/s sampling rate. Value K is the so-called "slew" rate of integrator 130.

FIG. 2 is a graphical representation of polar directivity patterns for a cardioid microphone employing microphone elements 101 and 105 if the gain equalization of the invention is disabled. Shown are polar directivity patterns at 500 Hz (solid outline), 1000 Hz (dashed outline) and 3000 Hz (dot-dashed outline). The directivity index of the resulting polar directivity patterns at 500 Hz is 1.7 dB, at 1000 Hz is 2.6 dB and at 3000 Hz is 3.6 dB. It is noted that the resulting polar directivity patterns are not very good cardioids.

FIG. 3 shows polar directivity patterns for the same microphone elements 101 and 105 with the gain equalization of the invention enabled. Shown are polar directivity patterns at 500 Hz (solid outline), 1000 Hz (dashed outline) and 3000 Hz (dot-dashed outline). The directivity index of the resulting polar directivity patterns at 500 Hz is 4.3 dB, at 1000 Hz is 4.3 dB and at 3000 Hz is 4.4 dB. Note that the resulting cardioids are much improved and that the directivity index is relatively flat over the frequency band.

FIG. 4 illustrates polar directivity patterns at 500 Hz for varying amounts of mismatch between microphone element 101 and microphone element 105 of FIG. 1. Shown is a polar directivity pattern (solid outline) for 0 dB of mismatch between microphone elements 101 and 105 and the corresponding directivity index (DI) is 4.8 dB. Also shown is a polar directivity pattern (dot-dashed outline) for 1 dB of mismatch between microphone elements 101 and 105 and the corresponding directivity index is 4.0 dB. Finally, shown is a polar directivity pattern (dashed outline) for 2 dB of mismatch between microphone elements 101 and 105 and the corresponding directivity index is 2.9 dB.

FIG. 5 illustrates in simplified form the signal flow diagram of the processing of signals from a plurality of microphone elements 501-1 through 501-N in order to realize the gain equalization. In this example, we have chosen to match the gain of the signal channels associated with microphone elements 501-1,501-3 through 501-N to the gain of the signal channel associated with microphone element 501-2. That is, the levels in the signal channels associated with microphone elements 501-1 and 501-3 through 501-N are matched to that of microphone element 501-2. Although the gains are being matched to that associated with microphone element 501-2, the gain associated with the signal channel of any of microphone elements 501 could have been selected to match the gain of the others to it.

As in the arrangement of FIG. 1, the signals from each of microphone elements 501-1 through 501-N are supplied via amplifiers 502-1 through 502-N to Codecs 503-1 through 503-N, respectively. Each of Codecs 503 convert the amplified signals from a corresponding one of microphone elements 501 to mu-law PCM format. The mu-law PCM output from each of Codecs 503 is converted to linear PCM format (not shown) in DSP 504. Then, the linear PCM representations of the outputs from Codec 503-1 and Codecs 503-3 through 503-N are supplied to gain differential correction factor generation units 505-1 and 505-3 through 505-N, respectively. Since the long term average broad band gain of the microphone signal channels corresponding to microphone elements 501-1 and 501-3 through 501-N are being matched to the signal channel of microphone element 501-2, in this example, the linear PCM format output of Codec 503-2 does not need to be adjusted. Since each of gain differential correction factor generation units 505-1 and 505-3 through 505-N is identical and operates the same, only gain differential correction factor generation unit 505-1 will be described in detail. To this end, the elements of each of gain differential correction factor generation units 505-1 and 505-3 through 505-N have been labeled with identical numbers. Indeed, the operation of each of gain differential correction factor generation units 505-1 and 505-3 through 505-N is substantially identical to the arrangement shown in FIG. 1 for the microphone signal channel corresponding to microphone element 101. Therefore, the elements in gain differential correction factor generation unit 505-1 that are the same and operate identically as those shown in FIG. 1 have been similarly numbered and will not be described again in detail. The only difference in gain differential correction factor generation unit 505-1 and the arrangement shown in FIG. 1 is that the gain differential correction factor 114 is applied directly to multiplier 110 to obtain the adjusted signal 117 and the gain of the microphone signal channel corresponding to microphone element 501-2 is not being adjusted. Thus, as shown in FIG. 5 pairs of microphone signal channels are formed between microphone signal channels corresponding to microphone element 505-2 and each of microphone element 505-1 and 505-3 through 505-N.

Figure 6:
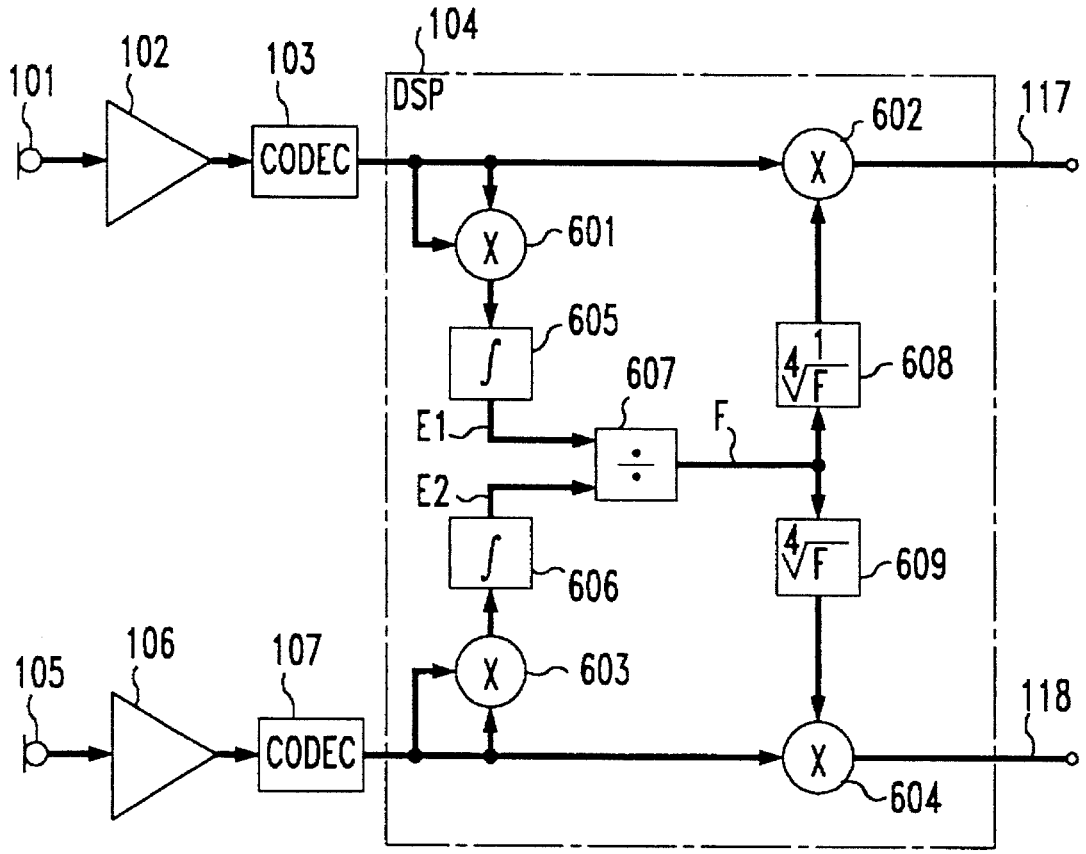
FIG. 6 is a signal flow diagram showing a two microphone element system employing another embodiment of the invention.

FIG. 6 illustrates in simplified form a signal flow diagram for matching the signal channel gains associated with at least one pair of microphone elements employing another embodiment of the invention. The signal flow diagram of FIG. 6 also illustrates the signal flow processing algorithm which may be employed in DSP 104 to realize the invention. Again, although the preferred embodiment of the invention is implemented in DSP 104, the invention may also be implemented as an integrated circuit or the like. Specifically, shown in FIG. 6 is microphone element 101 having its output supplied via amplifier 102 and Codec 103 to DSP 104 including the digital flow processing to realize this embodiment of the invention. Also shown is microphone element 105 whose output is supplied via amplifier 106 and Codec 107 to DSP 104. Again, in this example, microphone elements 101 and 105 are omni-directional microphone elements of the well-known electret type. As indicated above, Codecs 103 and 107 are also well-known in the art and are employed to convert the amplified output signals from microphone elements 101 and 105 into mu-law PCM format digital signals. The mu-law PCM digital signals from Codecs 103 and 107 are converted to linear PCM digital signals in DSP 104 in well-known fashion. The linear PCM digital signal from Codec 103 is then applied to multipliers 601 and 602. Similarly, the linear PCM digital signal from Codec 107 is applied to multipliers 603 and 604. Also supplied to multiplier 602 is a first gain correction factor $1\sqrt[4]{F}$ to adjust the gain of the linear PCM digital signal from Codec 103 to obtain an adjusted output signal 117 for microphone element 101. Similarly, multiplier 604 employs a second gain correction factor $\sqrt[4]{F}$ to adjust the gain of the linear PCM digital signal from Codec 107 to obtain an adjusted output signal 118 for microphone element 105. The first and second gain correction factors are generated via units 608 and 609 in well-known fashion by employing a ratio F of energy estimates in each of the microphone signal channels corresponding to microphone elements 101 and 105, E1 and E2, respectively. The ratio F of the energy estimates is generated by generating energy estimates E1 and E2 for the microphone element 101 signal channel and the microphone element 105 signal channel, respectively. Energy estimate E1 is obtained by first squaring the linear PCM digital signal from Codec 103 in multiplier 601 and then integrating the squared version via leaky integrator 605. Similarly, energy estimate E2 is obtained by squaring the linear PCM output from Codec 107 via multiplier 603 and then integrating it via leaky integrator 606. Then, the ratio of energy estimate E1 and E2 is obtained via divider 607 where F=E1/E2.

It will be apparent to those skilled in the art as how to expand the embodiment shown in FIG. 6 in order to match the signal channel gains of N microphone elements in similar fashion to the embodiment shown in FIG. 5.

What is claimed:

1. Apparatus for use with a plurality of microphone elements comprising:

means for generating a representation of a gain correction factor between signal channels associated with at least one pair of the plurality of microphone elements including means for obtaining an energy estimate in each signal channel associated with said at least one pair of microphone elements, means for algebraically subtracting said energy estimates to generate a difference value, means for determining the sign of the difference value and means for integrating the sign of the difference value to generate said representation of a gain correction factor; and means responsive to said representation of a gain correction factor for adjusting the long term average broad band gain of at least one of said signal channels, wherein the long term average broad band gains of said signal channels associated with said at least one pair of microphone elements are substantially matched to one another.

2. The apparatus as defined in claim 1 wherein said energy estimate is obtained using signals to be supplied as an output from each of said signal channels.

3. The apparatus as defined in claim 2 wherein said means for adjusting includes means in each of the signal channels being supplied with said representation of a gain correction factor to adjust the long term average broad band gain of the associated signal channel.

4. The apparatus as defined in claim 3 wherein said means for adjusting further includes means for adding said representation of a gain correction factor to a predetermined value to generate a first gain correction factor, means for subtracting said representation of a gain correction factor from said predetermined value to generate a second gain correction factor, multiplier means in one of said signal channels being supplied with said first gain correction factor for adjusting the long term average broad band gain of said one of said signal channels and means in the other of said signal channels being supplied with said second gain correction factor for adjusting the long term average broad band gain of said other of said signal channels.

5. Apparatus for use with a plurality of microphone elements comprising:

means for generating a representation of a gain correction factor between signal channels associated with at least one pair of the plurality of microphone elements including means for generating an energy estimate from unadjusted signals in each of said signal channels for each signal channel, means for integrating the energy estimate for each of said signal channels, means for generating a representation of a ratio of the integrated energy estimates for each of said signal channels to generate said representation of said gain correction factor; and means responsive to said representation of a gain correction factor for adjusting the long term average broad band gain of at least one of said signal channels including means in each of the signal channels and being supplied with said representation of a gain correction factor to adjust the long term average broad band gain of the associated signal channel, means for generating a first gain correction factor representative of one (1) over the fourth root of said ratio, means for generating a second gain correction factor representative of the fourth root of said ratio, multiplier means in one of said signal channels being supplied with said first gain correction factor for adjusting the long term average broad band gain of said one of said signal channels and multiplier means in the other of said signal channels being supplied with said second gain correction factor for adjusting the long term average broad band gain of said other of said signal channels wherein the long term average broad band gains of said signal channels are substantially matched, wherein the long term average broad band gains of said signal channels associated with said at least one pair of microphone elements are substantially matched to one another.

* * * * *